US009055855B2

(12) United States Patent
Büsing et al.

(10) Patent No.: US 9,055,855 B2
(45) Date of Patent: Jun. 16, 2015

(54) DISHWASHER

(75) Inventors: Johannes Büsing, Emersacker (DE); Bruno Reiter, Kösingen (DE); Markus Wecker, Gundremmingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1389 days.

(21) Appl. No.: 12/384,153

(22) Filed: Mar. 31, 2009

(65) Prior Publication Data

US 2009/0242004 A1 Oct. 1, 2009

(30) Foreign Application Priority Data

Apr. 1, 2008 (DE) ..... 10 2008 016 623

(51) Int. Cl.
*A47L 15/42* (2006.01)

(52) U.S. Cl.
CPC ..... *A47L 15/4212* (2013.01); *A47L 15/4246* (2013.01)

(58) Field of Classification Search
USPC ..... 134/56 D, 57 D, 58 D, 115 R
See application file for complete search history.

(56) References Cited

U.S. PATENT DOCUMENTS

| | | | | |
|---|---|---|---|---|
| 1,648,973 | A * | 11/1927 | Unke | 138/96 T |
| 2005/0133072 | A1* | 6/2005 | Yoon et al. | 134/58 D |
| 2006/0118148 | A1* | 6/2006 | Jeong et al. | 134/58 D |
| 2008/0060389 | A1* | 3/2008 | Blomberg et al. | 68/208 |

FOREIGN PATENT DOCUMENTS

| | | | |
|---|---|---|---|
| DE | 3614345 | C1 | 9/1987 |
| JP | 08154886 | A * | 6/1996 |

OTHER PUBLICATIONS

Machine Translation of Miyauchi et al. JP 08-154886, Jun. 1996.*

* cited by examiner

*Primary Examiner* — David Cormier
(74) *Attorney, Agent, or Firm* — James E. Howard; Andre Pallapies

(57) ABSTRACT

A dishwasher includes a dishwasher cavity having a base, a sump below the dishwasher cavity base, a collecting channel that catches liquid leaking over an upper edge of the sump, and a drainage element that drains liquid collected in the collecting channel past an electrical component that is in a region of the sump.

27 Claims, 3 Drawing Sheets

SECTIONAL VIEW TAKEN ALONG LINES I-I

DISHWASHER

BACKGROUND OF THE INVENTION

A sump with connections for a drain pump and for a circulating pump is usually located below a dishwasher cavity base of a dishwasher. Furthermore, the sump may include a connection for an aqua sensor.

Liquid may leak over the upper edge of the sump particularly in the case of an inclined position of the dishwasher. A collecting channel is known for the leakage protection of the electrical contacts of the afore-cited pumps and of the aqua sensor, the collecting channel extending in a crescent-shaped fashion around the sump. The collecting channel collects the leaking liquid in the event of liquid leaking out over the upper edge of the sump.

The afore-mentioned electrical components may be arranged directly adjacent to the sump in a manner which is advantage in terms of installation space. Such a compact component arrangement occupies a large angular range around the sump. Accordingly, the crescent-shaped collecting channel above the component arrangement must also extend around the sump at a large peripheral angle.

With an unfavorable inclined position of the dishwasher, the central region of the crescent-shaped collecting channel can form a liquid sink, while the two ends of the collecting channel are deflected upward. In this case, the collected leaking liquid can no longer drain off at the collecting channel ends, but this collects instead in the central region. There is the risk there of leaking liquid flowing over the edge of the channel and dripping onto the electrical components.

SUMMARY OF THE INVENTION

An object of the invention consists in providing a dishwasher, in which a reliable leaking water protection is achieved if the dishwasher is positioned in a slanted manner.

A retaining means is embodied as a collecting channel, to which at least one drainage element is assigned, which drains the leaking liquid collected in the collecting channel past electrical components arranged in the region of the sump. As a result, despite the minimal height of the channel edge of the collecting channel, the leaking liquid can be reliably guided past the electrical components. The height of the edge of the collecting channel may be restricted as a result of the minimal distance between the upper edge of the sump and the base contour of the dishwasher cavity.

The collecting channel may preferably be open at least at one end. The collected leaking liquid can thus drip from the collecting channel onto the base of the dishwasher. Accordingly, the additional drainage element may be arranged offset in respect of the open end of the collecting channel. It is particularly advantageous here if the drainage element is arranged approximately centrally between the two ends of the collecting channel.

As mentioned above, the distance between the upper edge of the sump and the base contour of the dishwasher cavity may be very minimal, depending on the installation space available, so that the collecting channel can only be embodied with a small channel height. With the dimensioning of the channel height, the clearance between the upper edge of the pump and the base of the dishwasher cavity is significant. In the case of the clearance being too minimal, the capillary effect in this gap may disable the drainage function of the collecting channel.

The drainage element can preferably include at least one liquid outlet opening provided in the collecting channel. The liquid outlet opening may be embodied in the channel base and open out into a hollow cylindrical drip connector. The collected liquid may run along the interior wall of the drip connector to a tapering drainage edge of the discharge nozzle.

The drainage edge can also pass into a drainage rib, along which leaking liquid can flow to a predetermined drip-off point of the drainage rib. The drip-off point can preferably be located above a collecting trough with a safety float. In the event of liquid leaking over the upper edge of the sump, the leaking liquid is thus directed in a prompt and targeted fashion into the region of the safety float. Alternatively, the afore-mentioned drainage rib can also connect directly, in other words without interconnection of the drip connector, to the collecting channel.

BRIEF DESCRIPTION OF THE DRAWINGS

An exemplary embodiment of the invention is shown below with reference to the appended Figures, in which.

DETAILED DESCRIPTION OF EXEMPLARY EMBODIMENTS OF THE PRESENT INVENTION

Figure 1:
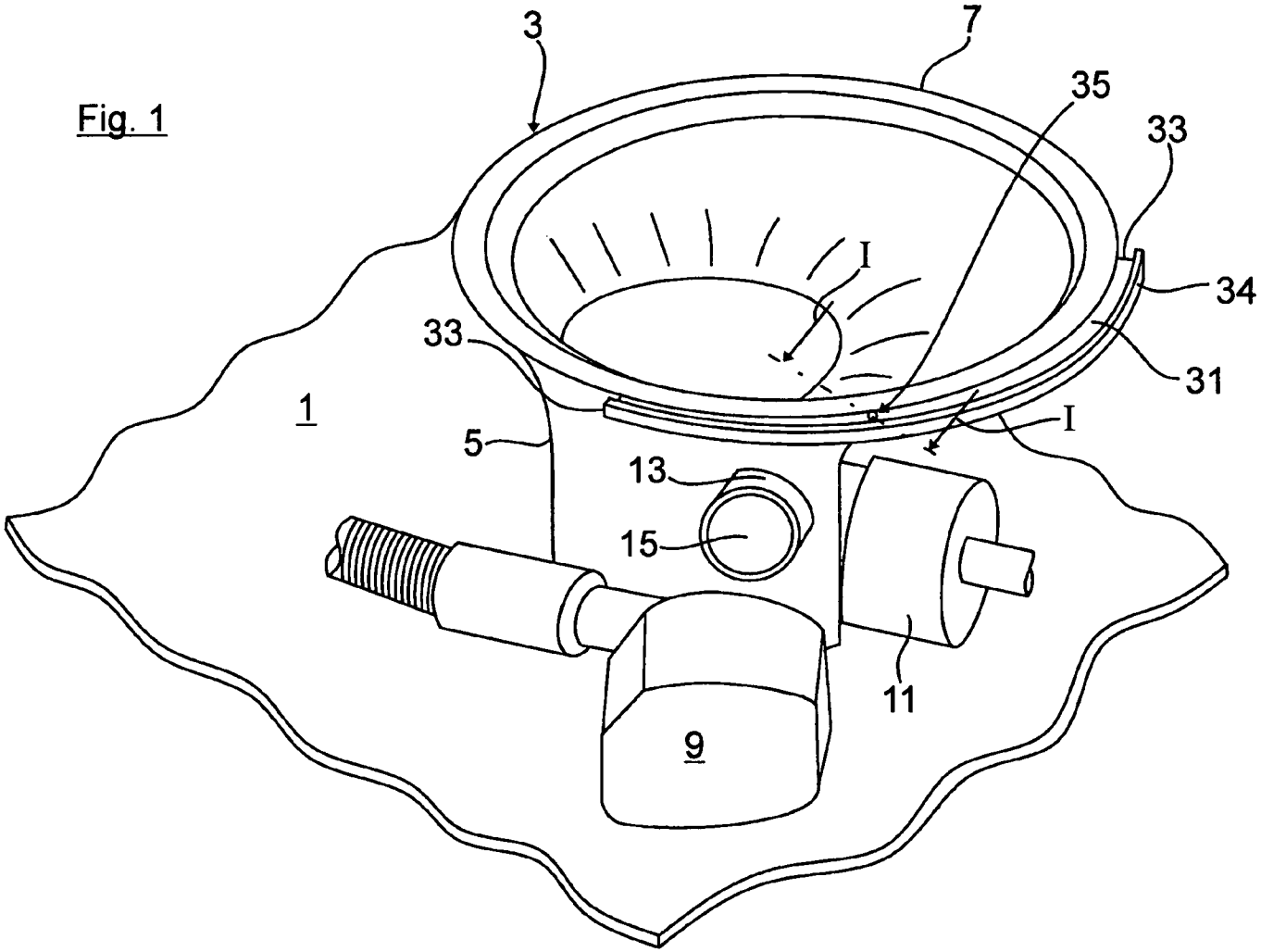
FIG. 1 shows a perspective representation of a sump arranged on a base of a dishwasher with assigned electrical components.

FIG. 1 shows a detailed view of a sump 3 of a dishwasher arranged on the appliance base 1. The sump 3 is located in the installation position below a dishwasher cavity not shown here for the sake of clarity. The sump 3 according to FIG. 1 has an essentially hollow cylindrical tub wall 5. This passes at the top into a tulip-shaped radially extended edge flange 7. Connectors for a drain pump 9 and for a circulating pump 11 are provided in the tub wall 5. Furthermore, a connector 13 is provided for an aqua sensor 15 which is only shown for indication reasons. The component arrangement comprising the drain pump 9, the circulating pump 11 and the aqua sensor 15 is positioned in a geometrically compact fashion in the region of the sump 3 below its radially extended edge flange 7.

Figure 2:
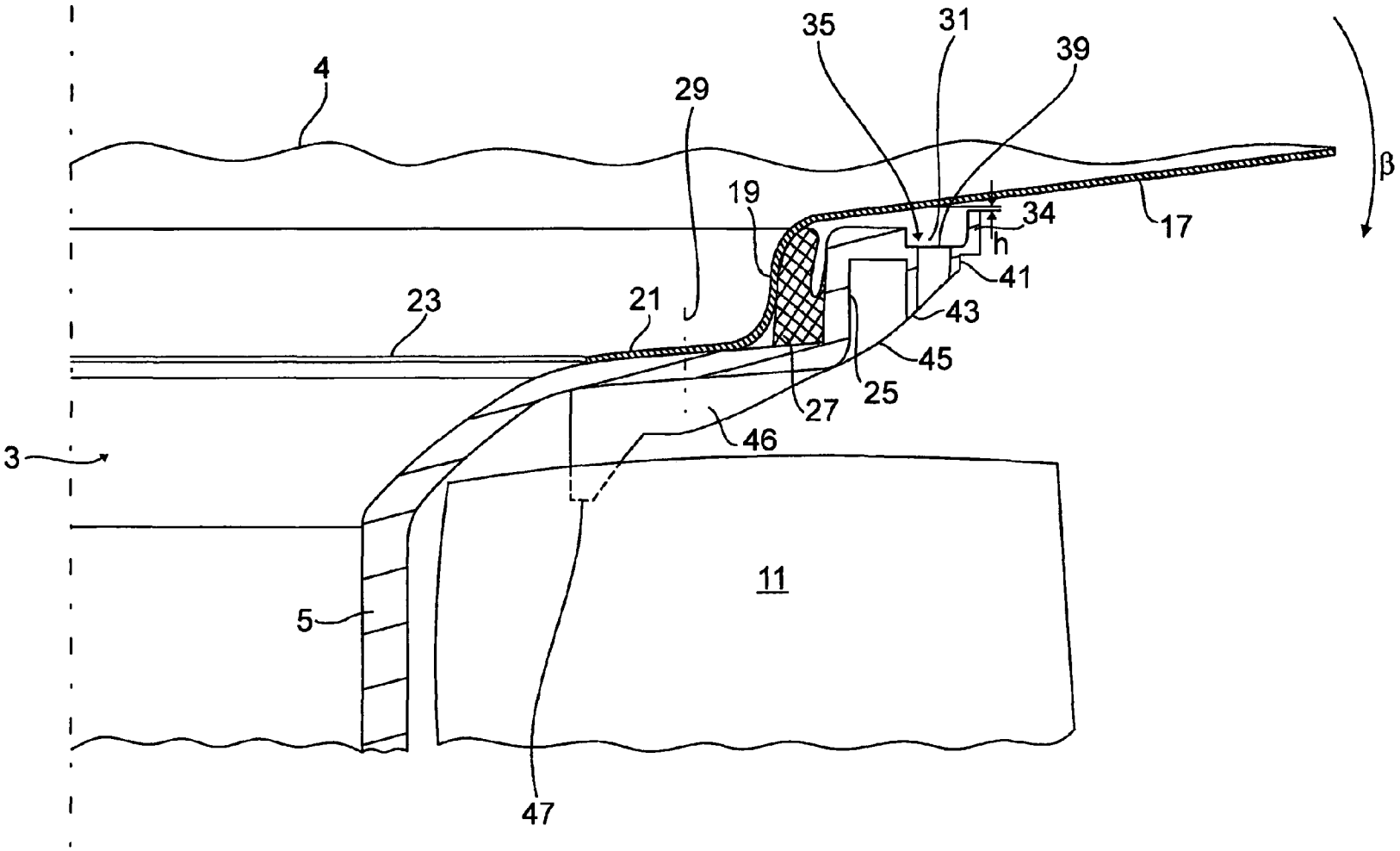
FIG. 2 shows an enlarged half section representation of the seal arrangement between the sump and a dishwasher cavity base in the sectional plane I-I from FIG. 1.

In the enlarged side sectional view in FIG. 2, the sealing arrangement between the container base 17 of the dishwasher cavity 4 and the sump 3 is shown. The container base 17 has an annular collar 19 protruding downward approximately in the center, which passes into a horizontal base flange 21. The base flange 21 delimits a liquid outlet opening 23 on the base. As shown in FIG. 2, the annular collar 19 of the container base 17 is radially delimited on the outside by a sealing edge 25 which is elevated from the edge flange 7 of the sump 3. A seal 27 is inserted into the annular joint provided between the sealing edge 25 and annular collar 19. The base flange 21 of the dishwasher cavity base 17 is screwed to the edge flange 7 of the sump 3 way of a screw connection 29 as indicated.

Figure 3:
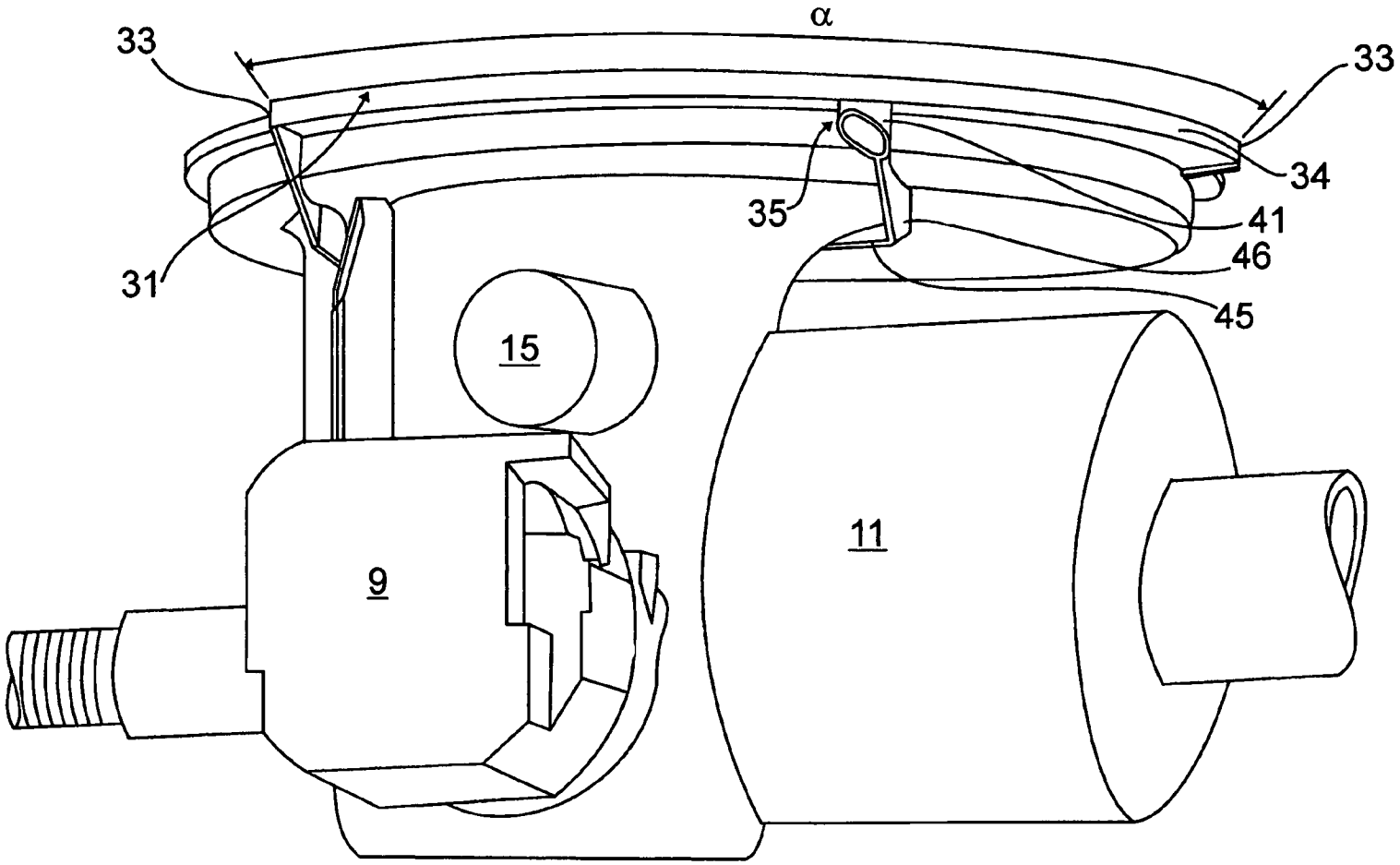
FIG. 3 shows a perspective representation from below of the sump with assigned electrical components.

A collecting channel 31 includes a channel bed and having an L-shaped profile is molded onto the top edge of the elevated sealing edge 25. The collecting channel 31 extends according to FIG. 3 in an approximately crescent-shaped fashion about a peripheral angle $\alpha$ on the outside about the elevated sealing edge 25 of the sump edge flange 7. The circulating and drain pumps 9, 11 as well as the aqua sensor are arranged in the angular range of the peripheral angle $\alpha$ spanning the collecting channel 31. As is also apparent from FIG. 2, the free distance h between an exterior limiting wall 34 of the collecting channel 31 and the container base 17 is very small. The installation height of the limiting wall 34 and thus on the whole the channel height is thus limited to lower values.

As is also apparent from FIG. 1, the collecting channel 31 is embodied to be open at its ends 33. Leaking liquid collecting in the collecting channel 31 can thus drip onto the open ends 33 of the collecting channel 31 in a targeted fashion. In addition to the open ends 33 of the collecting channel 31, a water drainage element 35 is provided approximately centrally therebetween. The water drainage element 35 has a liquid outlet opening 37 in accordance with FIG. 2, which is embodied in the channel base 39. The liquid outlet opening 37 opens into a hollow cylindrical drip-off connector 41, which is molded onto the lower side of the collecting channel 31. The drip-off connector 41 has a beveled edge with a tapering drainage edge 43 on its lower drip-off side. The drainage edge 43 passes flush into a ribbed edge 45 of a drainage rib 46. The drainage rib 46 extends in turn according to FIGS. 2 and 3 to the underside of the edge flange 7 to a predefined drip-off edge 47, which in accordance with FIG. 2 is located behind the circulating pump 11 and outside the angular range assumed by the electrical components 9, 11, 15.

The inventive additional drainage element 35 is particularly advantageous in the case of an inclined position of the dishwasher, in which the dishwasher is tilted by a few degrees to an angle β shown in FIG. 2. In accordance with the invention, an inclined position of the dishwasher is significant, in which the central region of the collecting channel 31 is tilted downwards by an angle β. In this case a liquid sink forms in the central region of the collecting channel 31, while the ends 33 of the collecting channel 31 are marginally deflected upwards. In such an inclined position, the level in the liquid depression of the collecting channel 31 would increase without an additional water drainage component 35, until the leaking liquid overflows and drips onto the electrical components 9, 11, 15.

As a result of the only minimal channel height, there is thus the risk in the case of certain inclined positions of the dishwasher of the electrical components 9, 11, 15 malfunctioning. In accordance with the invention, the additional drainage element 35 is thus arranged in the region of this liquid sink. The water collecting there in the case of an inclined position can thus run along the drip-off connector 13 and the rib edge 45 of the drainage rib 46 to the drip-off edge 47 and drip off there preferably directly into the region of the safety float. The leaking water collected in the collecting channel 31 can thus be guided in a targeted and prompt fashion directly to the safety float, as a result of which the safety system rapidly activates.

It is also possible by means of the additional drainage element 35 to dispense with complicated covers directly on the electrical components 9, 11, 15, like for instance a cover with a film hinge or a separate cover, which firstly has to be mounted onto the electrical components.

The invention claimed is:

1. A dishwasher comprising:

a dishwasher cavity configured to contain items to be washed by the dishwasher, the dishwasher cavity having a base;

a sump adjacent to and below the dishwasher cavity base, the sump having a perimeter and an upper outer edge located at the perimeter;

a collecting channel located external to the sump, the collecting channel configured to catch liquid leaking over the upper outer edge of the sump; and a drainage element in the collecting channel that drains liquid collected in the collecting channel to a location external to the sump and past an electrical component that is external to the sump, wherein the collecting channel is located adjacent to the upper outer edge of the sump.

2. The dishwasher of claim 1, wherein the collecting channel has two ends and is open at one of the two ends.

3. The dishwasher of claim 2, wherein the drainage element is offset with respect to the ends of the collecting channel.

4. The dishwasher of claim 2, wherein the drainage element is approximately centrally positioned between the two ends of the collecting channel.

5. The dishwasher of claim 1, wherein the drainage element comprises a liquid outlet opening in the collecting channel.

6. The dishwasher of claim 5, wherein the liquid outlet opening opens into a hollow cylindrical drip-off connector.

7. The dishwasher of claim 6, wherein the drip-off connector comprises a deflection edge on its drip-off side.

8. The dishwasher of claim 7, wherein the deflection edge tapers.

9. The dishwasher of claim 1, wherein the drainage element has a drainage rib for guiding leaking liquid.

10. The dishwasher of claim 9, wherein a deflection edge of a drip-off connector passes into a rib edge of the drainage rib.

11. The dishwasher of claim 1, wherein the drainage element has a predetermined drip-off point.

12. The dishwasher of claim 1, wherein the drainage element guides leaking liquid to a liquid detection facility.

13. The dishwasher of claim 1, wherein the collecting channel extends around a portion of the perimeter of the sump that is no more than half of an entire length of the perimeter.

14. The dishwasher of claim 1, wherein the collecting channel extends around a portion of the upper outer edge of the sump and has a shape that conforms to a shape of the upper outer edge of the sump.

15. The dishwasher of claim 14, wherein the shape of the upper outer edge of the sump is circular and the shape of the collecting channel is a geometric circular arc.

16. The dishwasher of claim 14, wherein the collecting channel has a bottom that is substantially parallel to and below the upper outer edge of the sump.

17. The dishwasher of claim 1, wherein the collecting channel has a bottom that is substantially parallel to and below the upper outer edge of the sump.

18. A dishwasher comprising:

a dishwasher cavity configured to contain items to be washed by the dishwasher, the dishwasher cavity having a base;

a sump located adjacent to and below the base, the sump having a perimeter;

a flange attached to the sump, the flange extending completely around the perimeter of the sump, the flange having a flange perimeter;

a collecting channel adjacent to the flange perimeter and configured to catch liquid that leaks over the flange at the flange perimeter, the collecting channel having two ends and extending around a portion of the flange perimeter that is less than the entire flange perimeter;

an electrical component located below the collecting channel and between the two ends of the collecting channel; and a drainage element configured to drain the liquid caught in the collecting channel such that the liquid avoids contact with the electrical component, wherein the flange is located adjacent to an upper outer edge of the sump.

19. The dishwasher of claim 18, wherein the collecting channel extends around a portion of the flange perimeter that is no more than half of the entire flange perimeter.

20. The dishwasher of claim 18, wherein the collecting channel is open at one of the two ends.

21. The dishwasher of claim 20, wherein the drainage element is offset with respect to the two ends of the collecting channel.

22. The dishwasher of claim 18, wherein the drainage element has a drainage rib for guiding the liquid.

23. The dishwasher of claim 22, wherein the drainage element has a predetermined drip-off point that guides the liquid to the drainage rib.

24. The dishwasher of claim 18, wherein the collecting channel extends around a portion of the upper outer edge of the sump and has a shape that conforms to a shape of the upper outer edge of the sump.

25. The dishwasher of claim 24, wherein the shape of the upper outer edge of the sump is circular and the shape of the collecting channel is a geometric circular arc.

26. The dishwasher of claim 24, wherein the collecting channel has a bottom that is substantially parallel to and below the flange.

27. The dishwasher of claim 18, wherein the collecting channel has a bottom that is substantially parallel to and below the flange.

* * * * *